US006698666B2

(12) United States Patent
Ohata et al.

(10) Patent No.: US 6,698,666 B2
(45) Date of Patent: Mar. 2, 2004

(54) FUEL INJECTION VALVE

(75) Inventors: Koichi Ohata, Kariya (JP); Nobuhisa Kakehashi, Anjo (JP); Toshiyuki Yoda, Kariya (JP); Eiji Itou, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/246,638

(22) Filed: Sep. 19, 2002

(65) Prior Publication Data

US 2003/0052202 A1 Mar. 20, 2003

(30) Foreign Application Priority Data

Sep. 20, 2001 (JP) ..... 2001-286934
Nov. 30, 2001 (JP) ..... 2001-367031

(51) Int. Cl.[7] ..... F02M 45/10
(52) U.S. Cl. ..... 239/89; 239/96; 239/533.5
(58) Field of Search ..... 239/88–91, 93–96, 239/124, 533.5, 533.9, 585.1–585.5

(56) References Cited

U.S. PATENT DOCUMENTS 3,777,977 A * 12/1973 Regneault et al. ..... 239/96
4,129,256 A * 12/1978 Bader et al. ..... 239/96
5,655,716 A * 8/1997 Mathis ..... 239/533.8
6,027,037 A 2/2000 Murakami et al.

* cited by examiner

*Primary Examiner*—Michael Mar
*Assistant Examiner*—Thach H Bui
(74) *Attorney, Agent, or Firm*—Nixon & Vanderhye P.C.

(57) ABSTRACT

In a fuel injection valve having a pressure control chamber, a nozzle, and an electromagnetic valve, a fuel flow-in passage, a fuel flow-out passage and at least a part of the pressure control chamber are formed in a single piece of a plate in such a manner that the part of the pressure control chamber is opened to an axial end surface of the plate and the fuel flow-out passage extends so as to penetrate the plate axially from an inner wall of the part of the pressure control chamber to another axial end surface of the plate and the fuel flow-in passage comprises a first passage extending from the axial end surface of the plate and a second passage extending from the inner wall of the part of the pressure control chamber, which intersect with each other within the plate, wherein an entrance orifice is formed in first passage.

8 Claims, 7 Drawing Sheets

FUEL INJECTION VALVE

CROSS REFERENCE TO RELATED APPLICATION

This application is based upon and claims the benefit of priority of Japanese Patent Applications No. 2001-286934 filed on Sep. 20, 2001 and No. 2001-367031 filed on Nov. 30, 2001, the contents of which are incorporated herein by reference.

BACKGROUND OF THE INVENTION

1. Field of the Invention

The present invention relates to a fuel injection valve, in which injection amount and injection timing are controlled by changing fuel pressure of a pressure control chamber.

2. Description of the Prior Art

A common rail fuel injection system, in which high pressure fuel accumulated in a common rail is injected into a combustion chamber, is well known. A fuel injection valve (injector), which is applicable to the common rail fuel injection system, has a pressure control chamber, whose pressure is controlled by fuel supplied thereto through an entrance orifice provided in a fuel flow-in passage and ejected therefrom through an exit orifice provided in a fuel flow-out passage for giving backpressure to a control piston movable together with a needle. The injection amount and injection timing are variable based on a change of the fuel pressure of the pressure control chamber (backpressure to the control piston).

The fuel pressure of the pressure control chamber is changed by an electromagnetic valve that is operative to open and close the fuel flow-out passage including the exit orifice through which the pressure control chamber communicates with a low pressure source.

In the injector mentioned above, it is required to accurately control not to fluctuate the fuel pressure of the pressure control chamber for securing a stable injection. To this end, it is important to accurately regulate and stabilize flow amount of fuel passing, in particular, through the entrance orifice provided in the fuel flow-in passage to the pressure control chamber.

To accurately regulate and stabilize the flow amount of fuel through the entrance orifice, length, diameter and position of the entrance orifice are main factors on designing the same. On designing the position thereof, it is inevitable that an outlet of the entrance orifice has to be exposed to a relatively large space for adequately attenuating fuel flow energy. For example, in the injector disclosed in U.S. Pat. No. 6,027,037, the outlet of the entrance orifice is connected to the pressure control chamber via a groove whose volume is relatively large so that the flow amount of fuel through the entrance orifice is stable. However, in the conventional injector disclosed in U.S. Pat. No. 6,027,037, a first plate in which the entrance orifice is formed and a second plate in which the exit orifice is formed are different members. This causes an inconvenience, on adjusting length of the entrance orifice for securing a target flow amount of fuel, that a change of enlarging the length of the entrance orifice is not sufficiently free, since the entrance orifice is limited to be positioned within the first plate whose thickness is relatively thin. Therefore, in this case, instead of enlarging the length of the entrance orifice, the diameter of the entrance orifice is obliged to be reduced for the adjustment of fuel flow. However, a slight change of the diameter of the entrance orifice is likely to affect largely on the fuel flow amount, compared with a slight change of the length of the entrance orifice. Accordingly, the change of the diameter of the entrance orifice is not preferable for a purpose of the fuel flow adjustment.

SUMMARY OF THE INVENTION

An object of the present invention is to provide a fuel injection valve having a piece of plate in which both of an entrance orifice and an exit orifice are formed so that length of the entrance orifice is easily changed for adjusting a flow amount of fuel passing therethrough to a target value.

To achieve the above objects, in the fuel injection valve having a pressure control chamber to which fuel is supplied from high pressure source via a fuel flow-in passage including an entrance orifice and from which the fuel is ejected to a low pressure source via a fuel flow-out passage including an exit orifice, a nozzle provided with a needle making an axial and reciprocal movement in response to fuel pressure in the pressure control chamber and with an injection hole to be opened and closed by the movement of the needle, and an electromagnetic valve operative to allow and interrupt a fuel communication between the fuel flow-out passage and the low pressure source for controlling the fuel pressure in the pressure control chamber, the fuel flow-in passage, the fuel flow-out passage and at least a part of the pressure control chamber are formed in a single piece of a plate. The part of the pressure control chamber is opened to an axial end surface of the plate and the fuel flow-out passage extends so as to penetrate the plate axially from an inner wall of the part of the pressure control chamber to another axial end surface of the plate. The fuel flow-in passage comprises a first passage extending from the axial end surface of the plate and a second passage extending from the inner wall of the part of the pressure control chamber, which intersect with each other within the plate. The entrance orifice is formed in one of the first and second passages.

It is preferable that one of the first and second passages is a blind passage and at least a part of the other of the first and second passages is the entrance orifice running into the blind passage. In case that the first passage is the blind passage, an end of the entrance orifice of the second passage is opened to the inner wall of the part of the pressure control chamber and another end thereof is opened to a vicinity of a dead end of the blind passage.

On the other hand, in case that the second passage is the blind passage whose inner diameter is axially substantially uniform, the first passage is provided at an end thereof on a side of the second passage with the entrance orifice opened to the blind passage at a position away by more than 0.2 mm from a dead end thereof. Preferably, the entrance orifice of the first passage is connected substantially perpendicularly to the second passage.

Further, it is preferable that an angle of the first passage to the axial end surface of the plate, which is an angle opposed to the second passage, falls within a range from 25° to 90° and an angle of the second passage to the axial end surface of the plate, which is an angle opposed to the first passage, falls within a range from 15° to 55°.

Furthermore, it is preferable that the inner wall of the part of the pressure control chamber is at least partly a conical shape inner wall whose diameter is larger toward the axial end surface of the plate and to which the second passage is opened.

Moreover, it is preferable that an extended axial line of the second passage passes through inside of the part of the pressure control chamber without running against the inner wall thereof.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application.

In the drawings.

DESCRIPTION OF THE PREFERRED EMBODIMENTS (First Embodiment)

Figure 1:
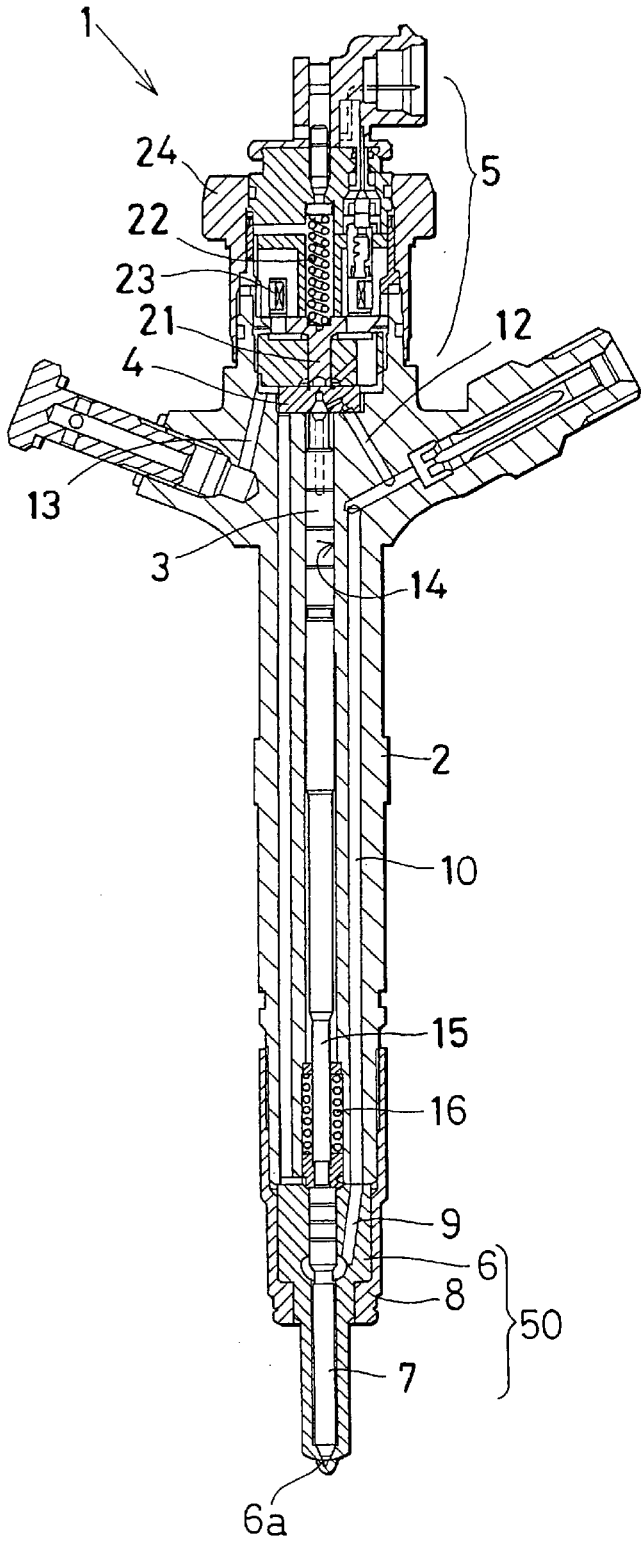
FIG. 1 is a cross sectional view of a fuel injection valve according to a first embodiment of the present invention.
Figure 2A:
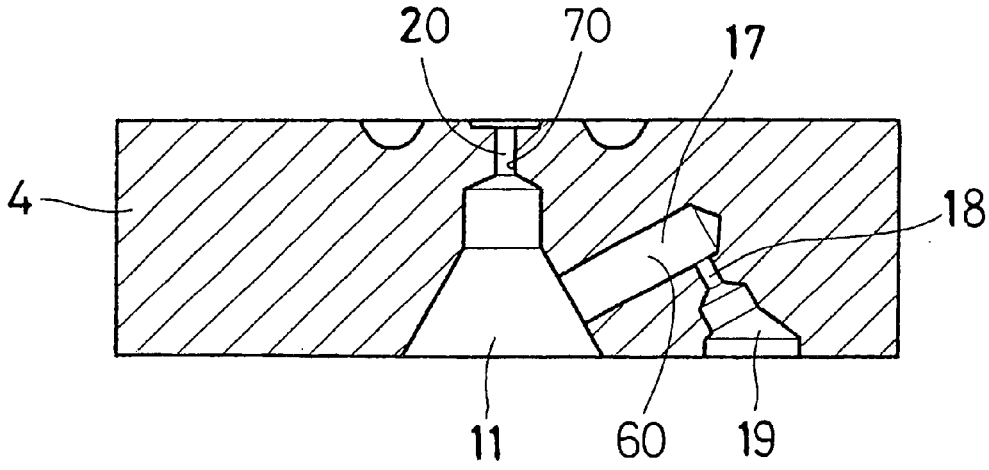
FIG. 2A is a cross sectional view of an orifice plate of the fuel injection valve of FIG. 1.
Figure 2B:
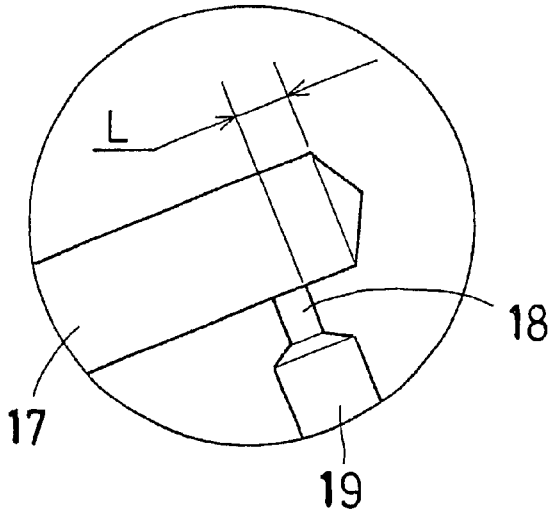
FIG. 2B is a partly enlarged view-of the orifice plate of FIG. 2A.

An injector 1 according to a first embodiment is described with reference to FIGS. 1, 2A and 2B. The injector 1 is inserted to and mounted on an engine head of an engine (not shown) and injects high pressure fuel supplied from a common rail (not shown) directly to each inside of cylinders of the engine. As shown in FIG. 1, the injector 1 is composed mainly of a nozzle 50, a nozzle holder 2, a control piston 3, an orifice plate 4 and an electromagnetic valve 5.

The nozzle 50 is composed of a nozzle body 6 provided at a leading end thereof with an injection hole 6*a*, a needle 7 disposed slidably and reciprocatingly in the nozzle body 6 and a retaining nut 8 with which the nozzle body is connected to a lower part of the nozzle holder 2.

The nozzle holder 2 is provided with a fuel introduction passage 10 through which high pressure fuel supplied from the common rail (high pressure source) is introduced to a fuel passage 9 formed inside the nozzle body 6, a fuel supply passage 11 through which the high pressure fuel from the common rail is supplied to a pressure control chamber 11 (also refer to FIG. 2A) and a fuel ejecting passage 13 through which the fuel from the control pressure chamber 11 is ejected to a low pressure source.

The control piston 3 is slidably housed in a cylinder 14 formed inside the nozzle holder 2. The control piston 3 is connected to the needle 7 via a pressure pin 15 slidably accommodated in a cylinder 14 formed inside the nozzle holder 2.

A spring 16 disposed around the pressure pin 15 and between the control piston 3 and the needle 7 biases the pressure pin 15 so as to urge the needle 7 in a valve closing direction (downward in FIG. 1).

The orifice plate 4 is arranged at an axial end of the nozzle holder 2 to which an upper end of the cylinder 14, which constitutes the pressure control chamber 11, is opened.

The orifice plate 4 is provided at an axial end with a part of the pressure control chamber 11 being opened to and communicating with the cylinder 14, a fuel flow-in passage 60 communicating with the fuel supply passage 12 of the nozzle holder 2, and a fuel flow-out passage 70 capable to communicate via the electromagnetic valve 5 with the fuel ejecting passage 13. An inner wall of the part of the pressure control chamber 11 is at least partly a conical shape inner wall whose diameter is larger toward the axial end surface of the orifice plate 4. The fuel flow-out passage 70 extends so as to penetrate the orifice plate 4 axially from the inner wall of the part of the pressure control chamber 11 to another axial end surface of the orifice plate 11. The fuel flow-out passage 70 is provided at an upper part thereof with an exit orifice 20. The fuel flow-in passage 60 is composed of a first passage 19 extending from the axial end surface of the orifice plate 4 and a second passage 17 extending from the inner wall of the part of the pressure control chamber 11, which intersect with each other within the orifice plate 4. The second passage 17 is a blind passage and an entrance orifice 18 formed partly in the first passage 19 runs into the second passage 17 (blind passage).

The entrance orifice 18 is formed by drilling from an axial end surface of the orifice plate 4. The second passage 17, whose diameter is axially substantially uniform, is formed as the blind passage by drilling from the inner wall of the part of the pressure control chamber 11 so that an extended axial line of the second passage 17 passes through inside of the part of the pressure control chamber 11 without running against the inner wall thereof. The entrance orifice 18 is connected substantially perpendicularly to the first passage 17 at a position away by more than 0.2 mm from a dead end of the first passage. Inner diameter (flow path diameter) of the exit orifice 20 is larger than that of the entrance orifice 18.

The electromagnetic valve 5 is composed of an armature 21 operative to allow and interrupt a flow communication between the fuel flow-out passage 70 and the fuel ejecting passage 13 by opening and closing the exit orifice 20, a spring 21 urging the armature 21 in a valve closing direction (downward in FIG. 1), a solenoid 23 driving the armature 21 in a valve opening direction. The electromagnetic valve 5 is mounted via the orifice plate 4 on the axial end of the nozzle holder 2 and connected to the nozzle holder 2 by a retaining nut 24.

When the solenoid 23 is energized, the armature 21 is attracted upward in FIG. 2 against the biasing force of the spring 22 so that the exit orifice 20 is opened. When current supply to the solenoid 23 stops, the armature 21 is moved back by the spring 22 so that the exit orifice 20 is closed.

Next, a fuel injection operation of the injector 1 is described.

Fuel is discharged from a fuel injection pump (not shown) and delivered to the common rail. High pressure fuel, which is accumulated to given pressure in the accumulated pressure chamber of the common rail, is introduced to the fuel passage 9 of the nozzle body 6 and to the pressure control chamber 11. When the electromagnetic valve 5 is in a valve closing state (in a state that the armature 21 closes the exit orifice 20), high pressure of fuel introduced to the pressure control chamber acts on the needle 7 via the control piston 3 and the pressure pin 15 and, in corporation with a biasing force of the spring 16, urges the needle 7 in a valve closing direction.

High pressure of fuel introduced in the fuel passage 9 acts on a pressure receiving surface of the needle 7 and urges the needle 7 in a valve opening direction. When the electromagnetic valve 5 is in a valve closing state, a force of urging the needle 7 in a valve closing direction is greater than that in a valve opening direction so that the needle 7 does not lift, thereby the injection hole 6*a* being closed not to inject fuel.

When the solenoid 23 is energized and the electromagnetic valve is in a valve opening state (in a state that the armature 21 opens the exit orifice 20), the fuel communication between the fuel flow-out passage 70 and the fuel ejecting passage 13 is allowed so that the fuel in the pressure control chamber 11 is ejected via the fuel ejecting passage 13 to the low pressure source. Even if the electromagnetic valve 5 is in a valve opening state, high pressure fuel continues to be supplied to the pressure control chamber 11. However, the fuel pressure of the pressure control chamber 11 acting on the control piston 3 is reduced.

Accordingly, the force of urging the needle 7 in a valve closing direction based on a sum of the fuel pressure of the pressure control chamber 11 and the biasing force of the spring 16 is reduced and, when the force of urging the needle 7 in a valve opening direction exceeds that in a valve closing direction, the needle 7 starts lifting so that the injection hole 6*a* is opened to inject fuel.

Then, when the current supply to the solenoid 23 stops and the armature 21 closes the exit orifice 20, the fuel pressure of the pressure control chamber 11 increases again. At a time when the force of urging the needle 7 in a valve closing direction exceeds that in a valve opening direction, the needle 7 is forced down so that the injection hole 6*a* is closed to terminate fuel injection.

According to the fuel injection valve 1 mentioned above, injection behaviors such as injection amount and injection timing are controlled by changing the fuel pressure of the pressure control chamber 11. Therefore, it is required to accurately control so as to stabilize the fuel pressure of the pressure control chamber 11 for securing stable fuel injection. It is inevitable for this purpose to stabilize a flow of fuel in the second passage 17 after the fuel passes through the fuel flow-in passage 60, in particular, in case that the entrance orifice 18 runs into the second passage 17.

According to a research and investigation based on a simulation analysis, it is proved that a distance L (refer to FIG. 2B) between a dead end of the second passage 17 (blind passage) and a point where the entrance orifice 18 is connected to the second passage 17 largely affects on the stabilized fuel flow.

Figure 3A:
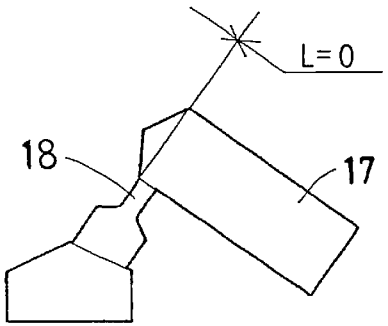
FIG. 3A is a schematic view of an entrance orifice connected to a blind passage of the orifice plate of FIG. 2A at a position away by first distance L from a dead end thereof.
Figure 3B:
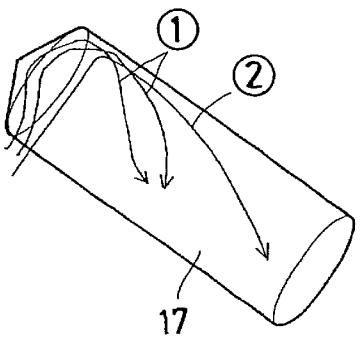
FIG. 3B is a schematic view showing streamlines of fuel flowing in the blind passage of FIG. 3A as an analysis result.
Figure 3C:
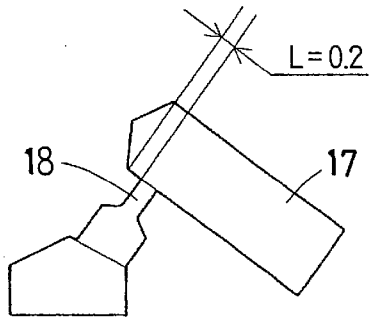
FIG. 3C is a schematic view of the entrance orifice connected to the blind passage of the orifice plate of FIG. 2A at a position away by second distance L from a dead end thereof.
Figure 3D:
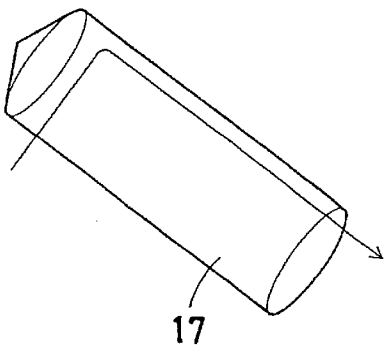
FIG. 3D is a schematic view showing streamlines of fuel flowing in the blind passage of FIG. 3C as an analysis result.
Figure 3E:
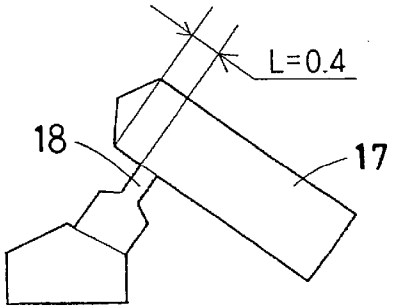
FIG. 3E is a schematic view of the entrance orifice connected to the blind passage of the orifice plate of FIG. 2A at a position away by third distance L from a dead end thereof.
Figure 3F:
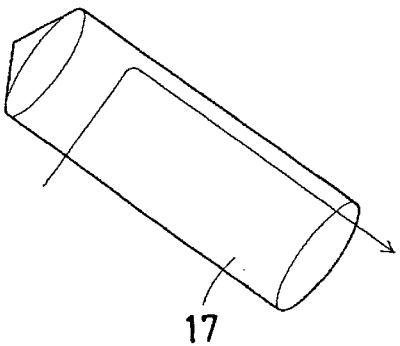
FIG. 3F is a schematic view showing streamlines of fuel flowing in the blind passage of FIG. 3E as an analysis result.

An analysis result is described below.

a) In case of L=0.0 mm, as shown in FIG. 3A streamlines of fuel flowing in the second passage 17 immediately after the entrance orifice 18 are classified into two patterns, as shown in FIG. 3B. One pattern is composed of streamlines ① of fuel flowing along a dead end surface of the second passage 17 and the other pattern is composed of stream lines ② of fuel running perpendicularly against an inner wall of the second passage 17 opposed to an outlet of the entrance orifice 18. Then, the vectors of the streamlines ① and ② cross each other. This means that the fuel flow is always unstable.

b) In case of L=0.2 mm, as shown in FIG. 3C, the streamlines of fuel flowing immediately after the entrance orifice 18 show a single pattern, as shown in FIG. 3D, that is, streamlines of fuel running perpendicularly against an inner wall of the second passage 17 opposed to an outlet of the entrance orifice 18. There exist no fuel flows whose vectors of streamlines cross each other.

c) In case of L=0.4 mm, as shown in FIG. 3E, the streamlines of fuel flowing immediately after the entrance orifice 18 show a single pattern, as shown in FIG. 3F, that is, streamlines of fuel running perpendicularly against an inner wall of the second passage 17 opposed to an outlet of the entrance orifice 18. There exist no fuel flows whose vectors of streamlines cross each other.

In case of L=0.2 mm or L=0.4 mm, the fuel flow is always stable, as mentioned above.

Figure 4:
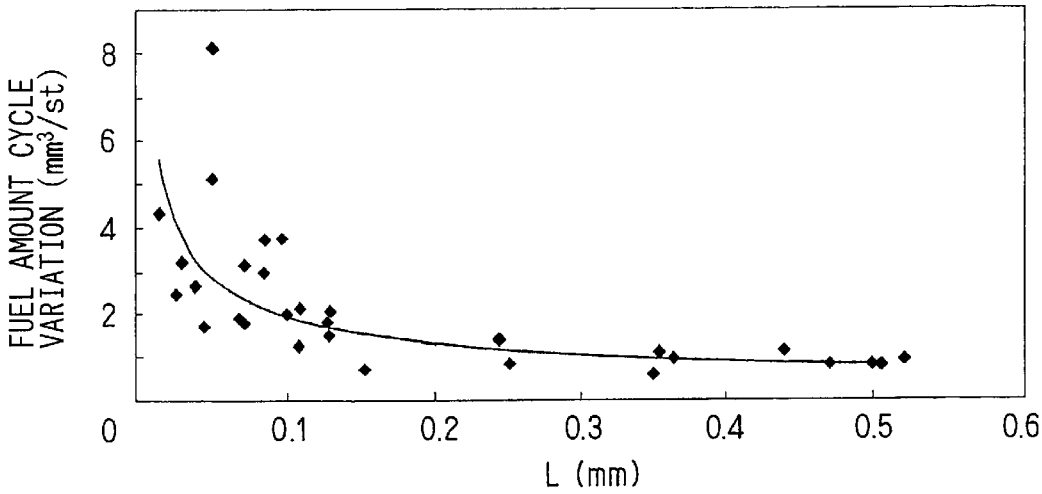
FIG. 4 is a chart showing a relationship between cycle variation of fuel amount and variation of the distance L of FIGS. 3A, 3C and 3E.

Next, fuel flow stabilization degree in the second passage 17 can be evaluated as an injection amount variation in every injection cycle. FIG. 4 shows a test result showing every injection cycle variation $2\sigma$ of injection amount, when the distance L is changed under conditions that fuel pressure is 160 MPa and width of drive pulse is 1.01 ms. According to this test result, it is proved that stabilization of every fuel injection largely depends on the distance L and, at the distance $L \geqq 0.2$ mm, every injection amount variation is relatively small. It can be concluded that, when the entrance orifice 18 is connected perpendicularly to the blind passage 17 whose inner diameter is axially uniform, the distance $L \geqq 0.2$ mm serves to reduce the every injection amount variation of the fuel injection valve 1.

Further, since the entrance orifice 18 and the exit orifice 20 are formed in a single piece of the orifice plate 4, an axial length of the orifice plate 4 is longer, compared with the conventional orifice plate made of two pieces, so that the orifice plate 4 has a sufficient space for securing an adequate length of the entrance orifice 18, whereby enhancing freedom on designing the entrance orifice 18 in such a manner that an angle of the first passage 19 to the axial end surface of the orifice plate 4 and an angle of the second passage 17 to the axial end surface of the orifice plate 4 are adequately adjusted.

(Second Embodiment)

Figure 5:
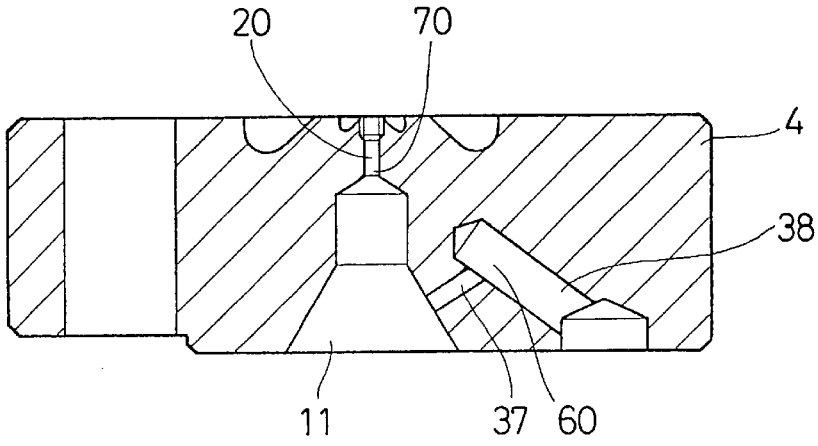
FIG. 5 is a cross sectional view of an orifice plate according to a second embodiment.

The orifice plate 4 according to the first embodiment may be modified to an orifice plate 4 according to a second embodiment, as shown in FIG. 5.

The orifice plate 4 according to the second embodiment is different from the orifice plate 4 according to the first embodiment in a point that the fuel flow-in passage 60 is composed of a first passage 38, which is a blind passage 38, extending from the axial end surface of the orifice plate 4 and a second passage 37, which is an entrance orifice 37, extending from the inner wall of the part of the pressure control chamber 11, which intersect with each other within the orifice plate 4. The first passage 38 is formed by drilling from an axial end surface of the orifice plate 4. The entrance orifice 37 is formed by drilling from the inner wall of the part of the pressure control chamber 11 so that an extended axial line of the second passage 17 passes through inside of the part of the pressure control chamber 11 without running against the inner wall thereof.

Figure 6A:
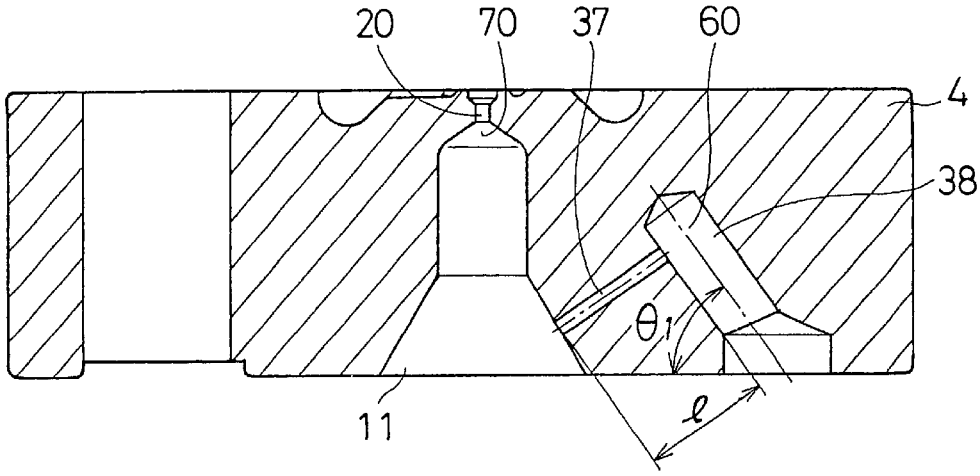
FIGS. 6A and 6B are schematic views of a first passage whose angle to an axial end surface of the orifice plate of FIG. 5 are changed.
Figure 6B:
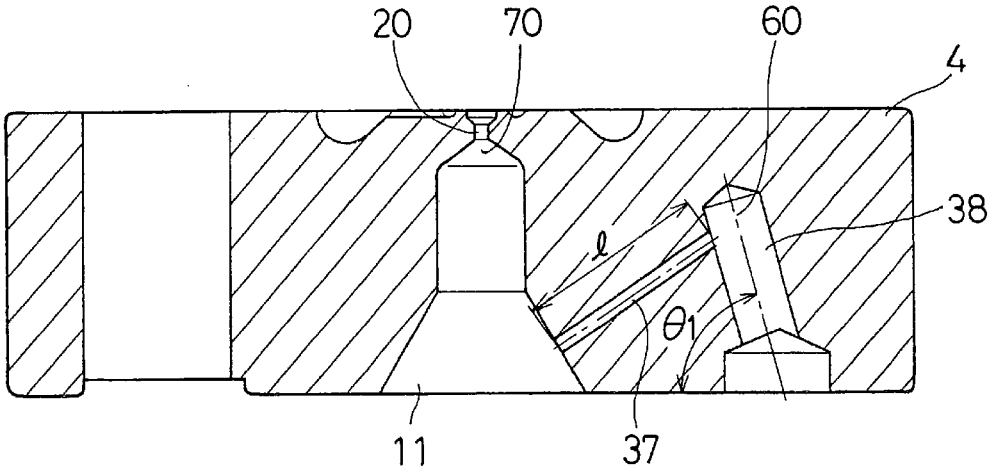
Figure 7A:
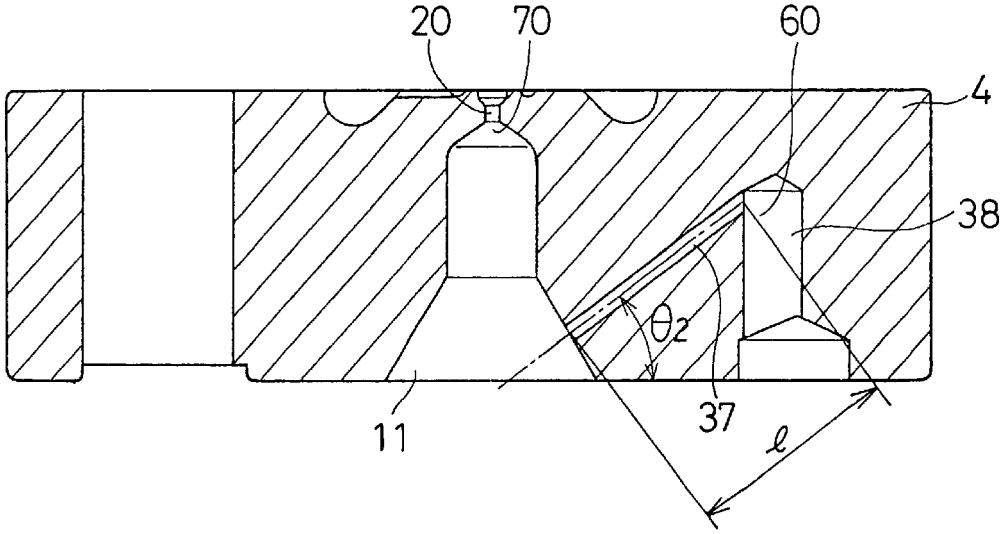
FIGS. 7A and 7B are schematic views of an entrance orifice whose angle to an axial end surface of the orifice plate of FIG. 5 are changed.
Figure 7B:
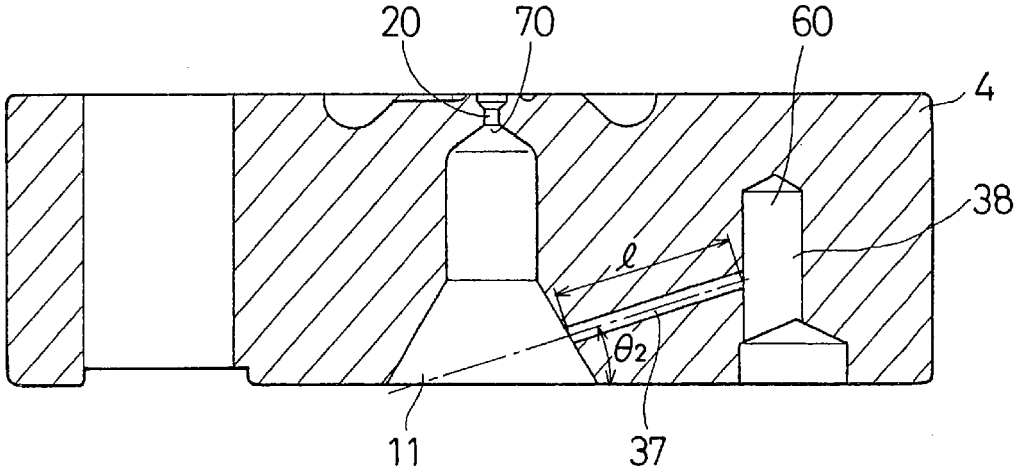
Figure 8:
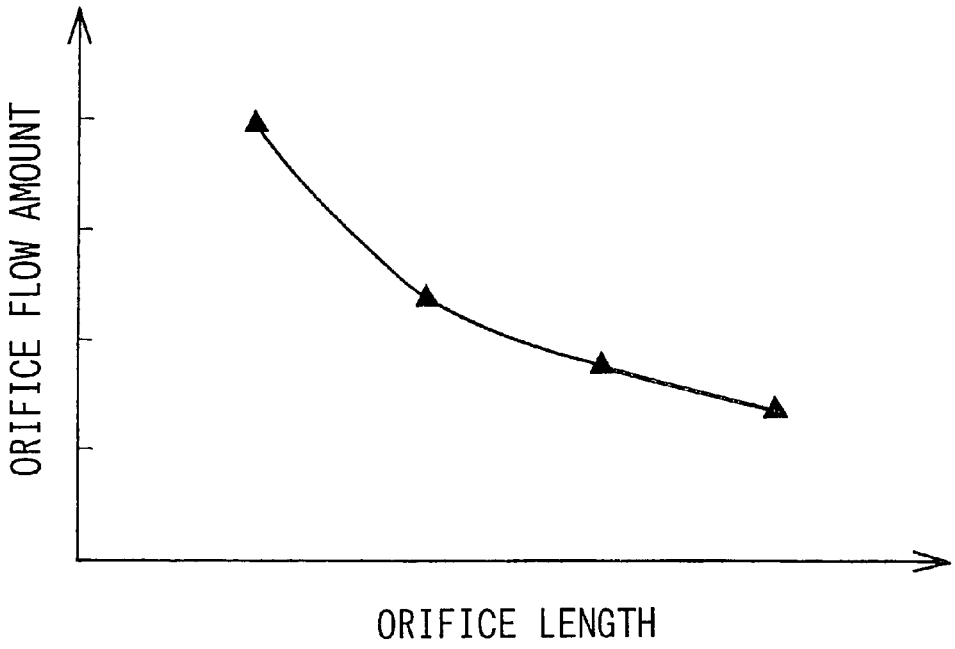
FIG. 8 is a chart showing a relationship between an orifice flow amount and an orifice length.

According to the second embodiment, since the entrance orifice 37 and the exit orifice 20 are formed in a single piece of the orifice plate 4, similarly to the first embodiment, an axial length of the orifice plate 4 is longer, compared with the conventional orifice plate made of two pieces, so that the orifice plate 4 has a sufficient space for securing an adequate length of the entrance orifice 37, whereby enhancing freedom on designing the entrance orifice 37 in such a manner that an angle $\theta_1$ of the first passage (blind passage) 38 to the axial end surface of the orifice plate 4, as shown in FIGS. 6A and 6B, and an angle of the second passage (entrance orifice) 37 to the axial end surface of the orifice plate 4, as shown in FIGS. 7A and 7B, are adequately adjusted.

According to an investigation analysis, it is preferable that the angle $\theta_1$ of the first passage (blind passage) 38 to the axial end surface of the orifice plate 4, falls within a range from 25° to 90° and the angle $\theta_2$ of the second passage (entrance orifice) 37 to the axial end surface of the orifice plate 4 falls within a range from 15° to 55°.

As shown in FIG., 8, an amount of fuel passing through the entrance orifice 37 is variable according to a variation of a length of the entrance orifice 37 and the length of the entrance orifice 37 can be enlarged by changing the angle $\theta_1$ or $\theta_2$ of the first or second passages 38 or 37 from a state shown in FIG. 6A or 7B to that shown in FIG. 6B or 7A. Accordingly, it is very easy to slightly change the flow amount of fuel passing through the entrance orifice 37 in order to secure accurate and stable fuel injection.

What is claimed is:

1. A fuel injection valve comprising:

a pressure control chamber to which fuel is supplied from high pressure source via a fuel flow-in passage including an entrance orifice and from which the fuel is ejected to a low pressure source via a fuel flow-out passage including an exit orifice, a nozzle provided with a needle making an axial and reciprocal movement in response to fuel pressure in the pressure control chamber and with an injection hole to be opened and closed by the movement of the needle, and an electromagnetic valve operative to allow and interrupt a fuel communication between the fuel flow-out passage and the low pressure source for controlling the fuel pressure in the pressure control chamber, wherein the fuel flow-in passage, the fuel flow-out passage and at least a part of the pressure control chamber are formed in a single piece of a plate in such a manner that the part of the pressure control chamber is opened to an axial end surface of the plate and the fuel flow-out passage extends so as to penetrate the plate axially from an inner wall of the part of the pressure control chamber to another axial end surface of the plate and the fuel flow-in passage comprises a first passage extending from the axial end surface of the plate and a second passage extending from the inner wall of the part of the pressure control chamber, which intersect with each other within the plate, and, further, wherein the entrance orifice is formed in one of the first and second passages.

2. A fuel injection valve according to claim 1, wherein one of the first and second passages is a blind passage and at least a part of the other of the first and second passages is the entrance orifice running into the blind passage.

3. A fuel injection device according to claim 1, wherein the second passage is the blind passage whose inner diameter is axially substantially uniform and the first passage is provided at an end thereof on a side of the second passage with the entrance orifice opened to the blind passage at a position away by more than 0.2 mm from a dead end thereof.

4. A fuel injection valve according to claim 3, wherein the entrance orifice of the first passage is connected substantially perpendicularly to the second passage.

5. A fuel injection device according to claim 1, wherein an angle of the first passage to the axial end surface of the plate, which is an angle opposed to the second passage, falls within a range from 25° to 90°.

6. A fuel injection device according to claim 1, wherein an angle of the second passage to the axial end surface of the plate, which is an angle opposed to the first passage, falls within a range from 15° to 55°.

7. A fuel injection device according to claim 1, wherein the inner wall of the part of the pressure control chamber is at least partly a conical shape inner wall whose diameter is larger toward the axial end surface of the plate and to which the second passage is opened.

8. A fuel injection device according to claim 1, wherein an extended axial line of the second passage passes through inside of the part of the pressure control chamber without running against the inner wall thereof.

* * * * *